US011098895B2

(12) United States Patent
Glasband et al.

(10) Patent No.: US 11,098,895 B2
(45) Date of Patent: Aug. 24, 2021

(54) EMISSIONS ELIMINATOR BY TOTAL COMBUSTION

(71) Applicants: Harold Glasband, West Palm Beach, FL (US); James W. Moore, Mogadore, OH (US); Jacob M. Youngman, Palm Beach Gardens, FL (US); Anthony R. Trianfante, Aurora, OH (US)

(72) Inventors: Harold Glasband, West Palm Beach, FL (US); James W. Moore, Mogadore, OH (US); Jacob M. Youngman, Palm Beach Gardens, FL (US); Anthony R. Trianfante, Aurora, OH (US)

(73) Assignee: Total Combustion LLC, Palm Beach Gardens, FL (US)

( * ) Notice: Subject to any disclaimer, the term of this patent is extended or adjusted under 35 U.S.C. 154(b) by 0 days.

(21) Appl. No.: 17/085,303

(22) Filed: Oct. 30, 2020

(65) Prior Publication Data

US 2021/0131661 A1 May 6, 2021

Related U.S. Application Data

(60) Provisional application No. 62/928,489, filed on Oct. 31, 2019.

(51) Int. Cl.
*F23D 14/02* (2006.01)
*F23D 14/32* (2006.01)
(Continued)

(52) U.S. Cl.
CPC ..... *F23D 14/32* (2013.01); *F02B 43/10* (2013.01); *F02B 2043/103* (2013.01); *F23D 14/60* (2013.01)

(58) Field of Classification Search
CPC ..... F23D 14/32; F23D 14/60; F02B 43/10; F02B 2043/103
(Continued)

(56) References Cited

U.S. PATENT DOCUMENTS 2,829,731 A 4/1958 Clayton
3,891,847 A * 6/1975 Schmidt ..... F23N 5/08 250/342
(Continued)

FOREIGN PATENT DOCUMENTS

EP 3149300 B1 8/2018

*Primary Examiner* — Avinash A Savani
(74) *Attorney, Agent, or Firm* — Benesch, Friedlander, Coplan & Aronoff LLP

(57) ABSTRACT

An innovative oxyhydrogen (HHO) burner system including one or more burner systems is provided to eliminate emissions through total combustion. Each burner system includes at least one HHO gas supply and an external natural gas supply, both of which are connected to a gas mixer. A controller regulates the amounts of incoming HHO gas and the natural gas through being mixed. The mixed gas is supplied to each burner assembly with a predetermined pressure and flowrate to generate a flame for the total combustion of the exhaust stream inside the exhaust pipe. With feedback from an exhaust measuring system inside the exhaust pipe adjacent the outlet, the controller can adjust the burner system for optimal operations and achieve total combustion. Thus, by passing the exhaust or gases through a substantial cross-section covered by each flame, emissions can be greatly reduced or eliminated.

17 Claims, 10 Drawing Sheets

(51) Int. Cl.
*F02B 43/10* (2006.01)
*F23D 14/60* (2006.01)

(58) Field of Classification Search
USPC ..... 431/354, 5, 202
See application file for complete search history.

(56) References Cited

U.S. PATENT DOCUMENTS

| | | | | |
|---|---|---|---|---|
| 4,113,838 | A | 9/1978 | Koike et al. | |
| 5,707,596 | A * | 1/1998 | Lewandowski | F23G 5/14 423/235 |
| 6,775,972 | B2 | 8/2004 | Twigg | |
| 2006/0048500 | A1 | 3/2006 | Loving | |
| 2012/0181483 | A1 * | 7/2012 | Simmons | C10J 3/485 252/373 |
| 2014/0370448 | A1 * | 12/2014 | Aldrich | F23G 7/085 431/202 |

* cited by examiner

EMISSIONS ELIMINATOR BY TOTAL COMBUSTION

The current application claims a priority to the U.S. Provisional Patent application Ser. No. 62/928,489 filed on Oct. 31, 2019.

FIELD OF THE INVENTION

The present invention relates generally to emissions control equipment. More specifically, the present invention relates to an oxyhydrogen and natural gas burner system that can efficiently and conveniently be attached to new and existing exhaust stack and equipment to reduce or eliminate harmful emissions through total combustion.

BACKGROUND OF THE INVENTION

Devices for reducing or eliminating dangerous emissions from emission-generating systems are in high demand. Heavy oil extracted using existing techniques is known to produce significant emissions including CO2, SOx, NOx, and particulate matter, etc. The use of natural gas, which produces lower levels of CO2, NOx, and SOx emissions per unit of energy than any other fossil fuel except pure hydrogen, does not require expensive boilers, or reduction equipment for NOx reduction, flue gas desulfurization, and/or particulate matter emissions. Although natural gas is a highly effective fuel source, it is also, in many instances, a nonideal and expensive method for simply raising heat. The use of alternative "dirty" fuels requires use of emission reduction equipment such as selective catalytic reduction and selective noncatalytic reduction of NOx, flue gas desulfurization to remove SOx, and electrostatic precipitation or filtration of particulate matter.

Many types of combustion equipment, including conventional steam generators and boilers, inherently produce substantial amounts of combustion or "stack gases" owing to the nature of the combustion process employed. Thus, the products of the combustion cannot be prevented from entering the atmosphere when using these types of combustion equipment. The highly undesirable environmental impact of any such large-scale combustion has limited the use of surface steam generation by boilers in many areas where atmospheric pollution has reached critical levels.

Conventional surface steam generators, particularly when fired using low-cost fuels, emit substantial amounts of objectionable combustion gases. Such side effect limits the use of fuels such as residual oil, leased crude oil, and other carbonaceous fuels.

Furthermore, much currently available combustion equipment requires that the combustion process be essentially "clean."

Accordingly, there is a need for devices with which to effectively remove or reduce undesirable material attendant in the combustion process. The present invention is intended to solve the problems associated with the creation of objectionable combustion gases through an innovative configuration for a device designed to eliminate emissions.

SUMMARY OF THE INVENTION

An innovative oxyhydrogen (HHO) burner system including one or more hydroburner is offered to eliminate emissions through total combustion. The HHO burner system can be added to any exhaust system and/or exhaust stack to reduce emissions by passing the exhaust and/or gases through the flames and heat created by the hydroburner to create a total combustion environment. The HHO burner system works by adding one or more custom-made hydroburner system to any stack, duct, or pipe, and delivering to the burner natural gas, propane, or any other fossil fuel gas and any type of water gas, such as HHO or Brown's gas, with or without compressed air, to create a total combustion of the exhaust before being released to the open environment.

Each hydroburner system uses a gas pipe to connect a hydroburner to a burner assembly, which provides a controlled flame to a cross-section of the exhaust pipe where an exhaust stream with emissions passes through. The hydroburner system includes at least one HHO gas supply and an external natural gas supply, both of which are controlled by a controller that regulates the ratio of amount of the incoming HHO gas to the natural gas. The at least one HHO gas supply is connected to a gas mixer through a spark arrestor which is also controlled by the controller to provide safety shutdown of the hydroburner system in the case a flash back occurs to the at least one HHO gas supply. The external natural gas supply is connected to an actuator through a series of check valves and flow control valves. The actuator is controlled by the controlled and connected to the gas mixer, where the predetermined amount of incoming HHO gas and external natural gas are mixed. The mixed gas is supplied to each burner assembly through a metering device and limiting valve, both of which are controlled by the controller to achieve a predetermined pressure and flowrate of the mixed gas being used to generate the flame for the total combustion of the exhaust stream inside the exhaust pipe. Thus, by passing all exhaust or gases through a substantial cross-section covered by each flame, emissions can be greatly reduced or even, in many cases, eliminated, including emissions of NOx, carbon, and sulfur dioxide, etc.

Further, the HHO burner system uses a plurality of sensors to detect the emission content of the exhaust stream before exiting the exhaust pipe. The plurality of sensors is positioned inside the exhaust pipe adjacent the outlet and connected to a measurement system, which sends measured data to the controller. By making adjustments of the hydroburner through the controller, the HHO burner system can achieve total combustion and elimination of emissions from the exhaust. Additionally, the HHO burner system provides efficient and convenient installation to any new and existing exhaust stack, pipe, and/or duct to ensure minimum system downtime and achieve the highest efficiency with the lowest costs.

DETAIL DESCRIPTIONS OF THE INVENTION

Figure 1:
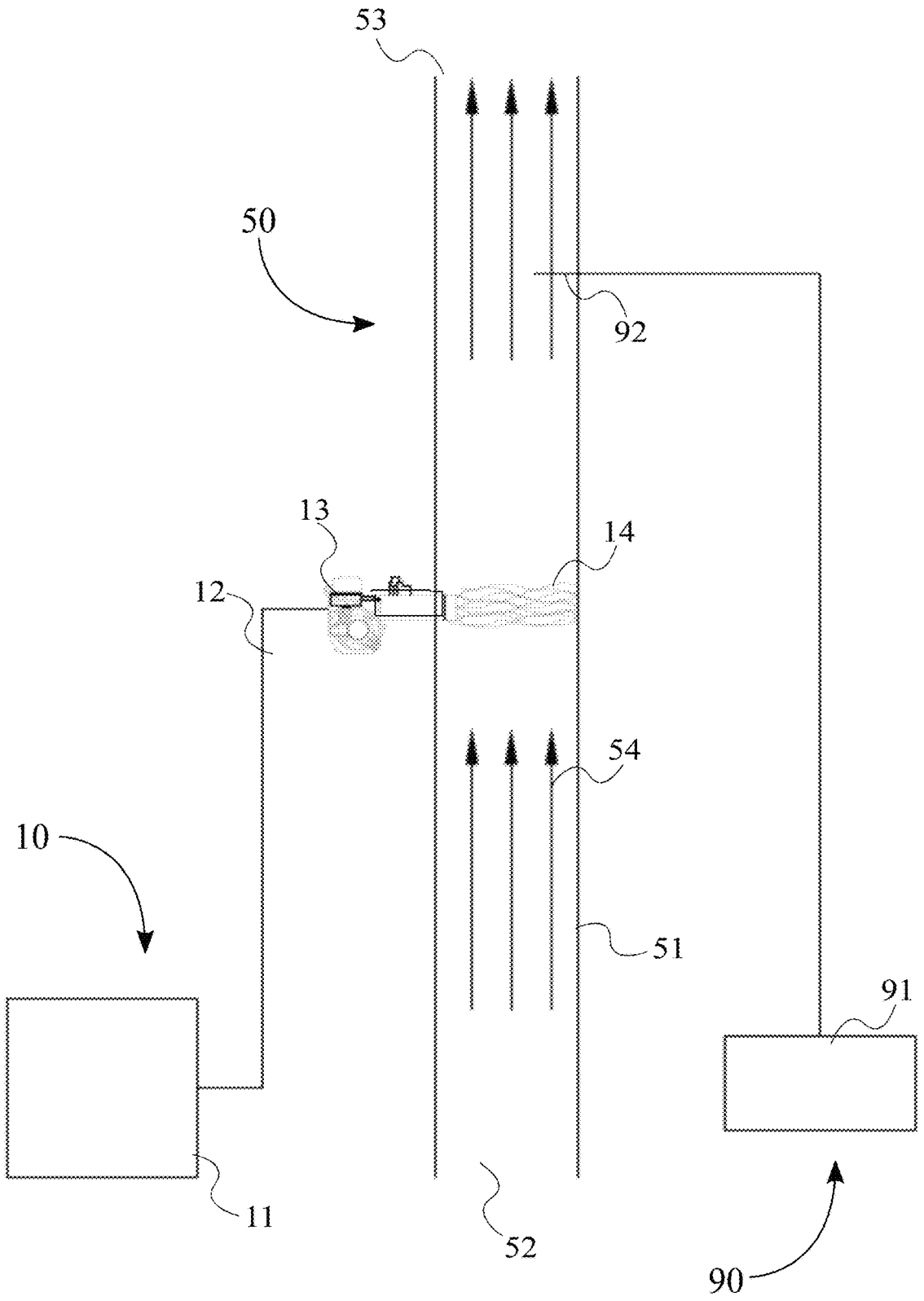
FIG. 1 is a system diagram of the present invention.
Figure 2:
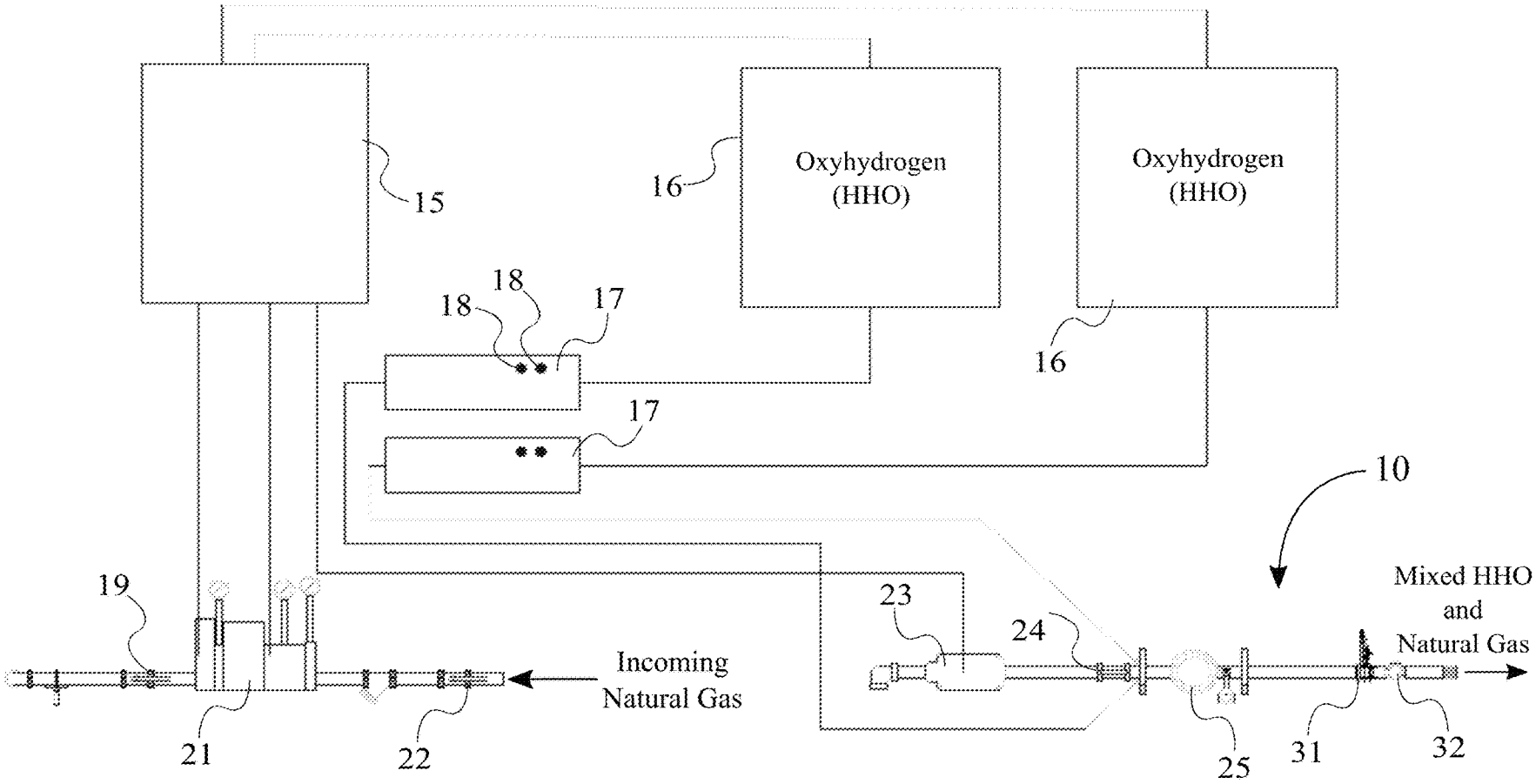
FIG. 2 is a diagram of a hydroburner system of the present invention.
Figure 3:
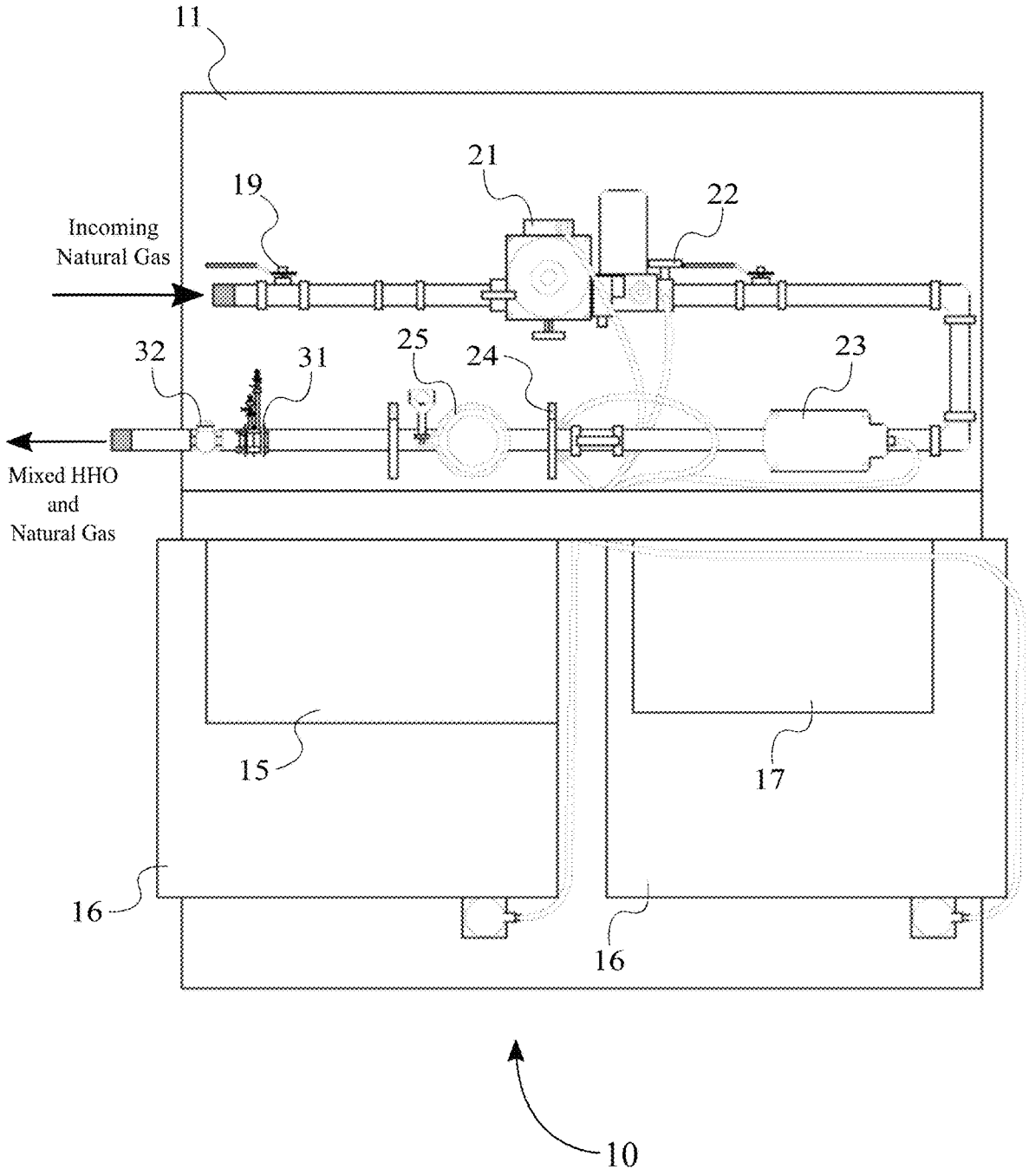
FIG. 3 is a top view of an embodiment of the hydroburner system of the present invention.
Figure 4:
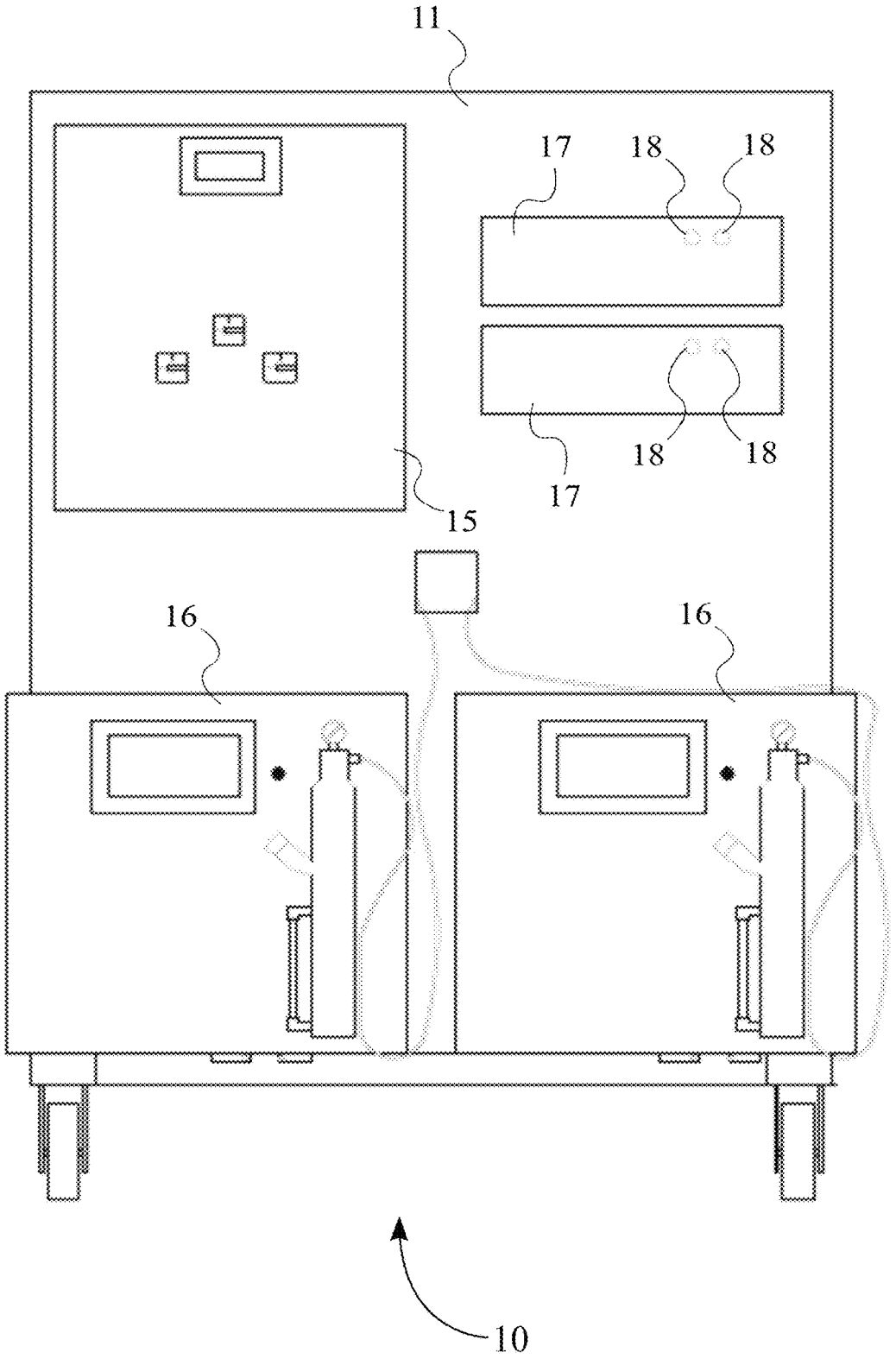
FIG. 4 is a front view of an embodiment of the hydroburner system of the present invention.
Figure 5:
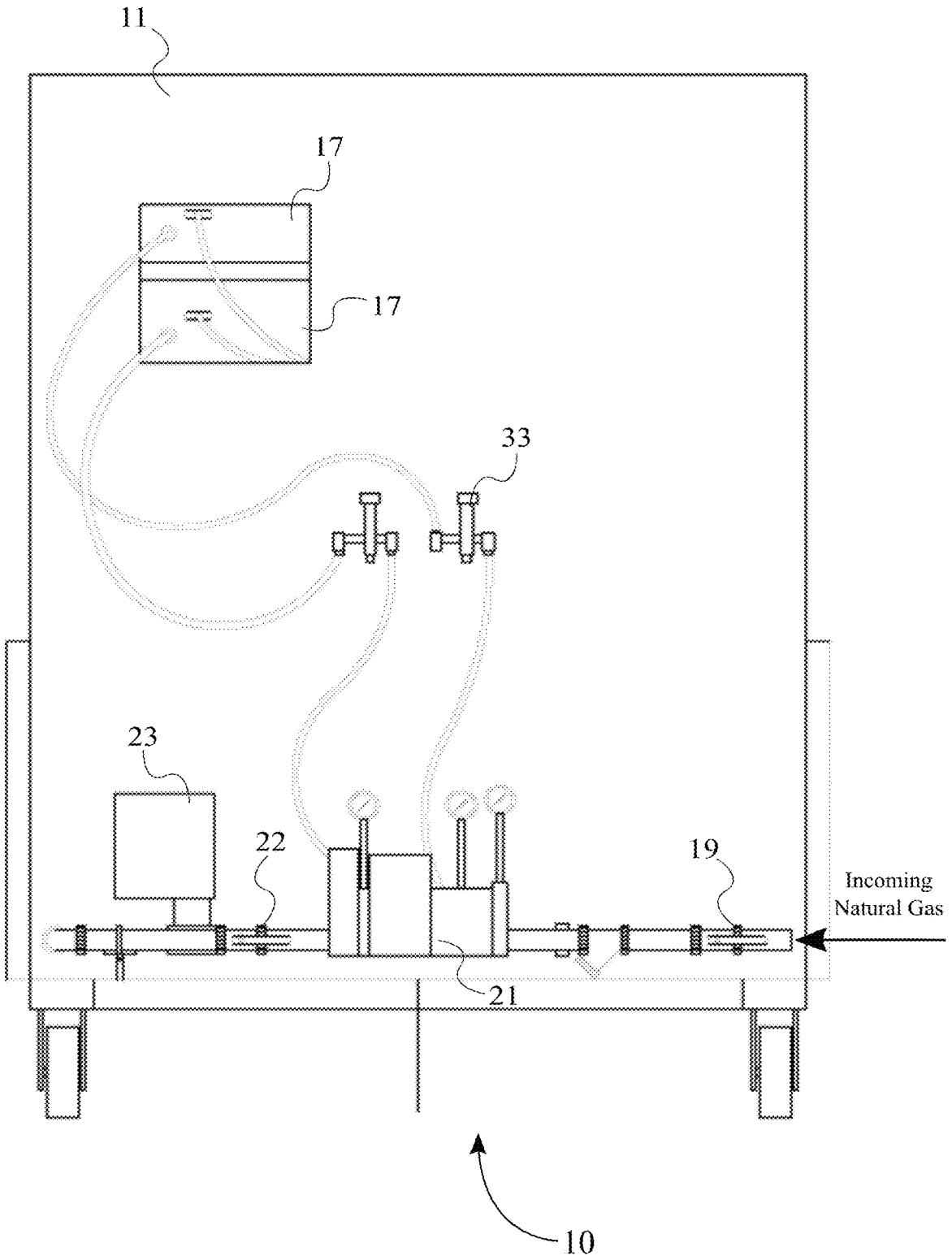
FIG. 5 is a back view of an embodiment of the hydroburner system of the present invention.
Figure 6:
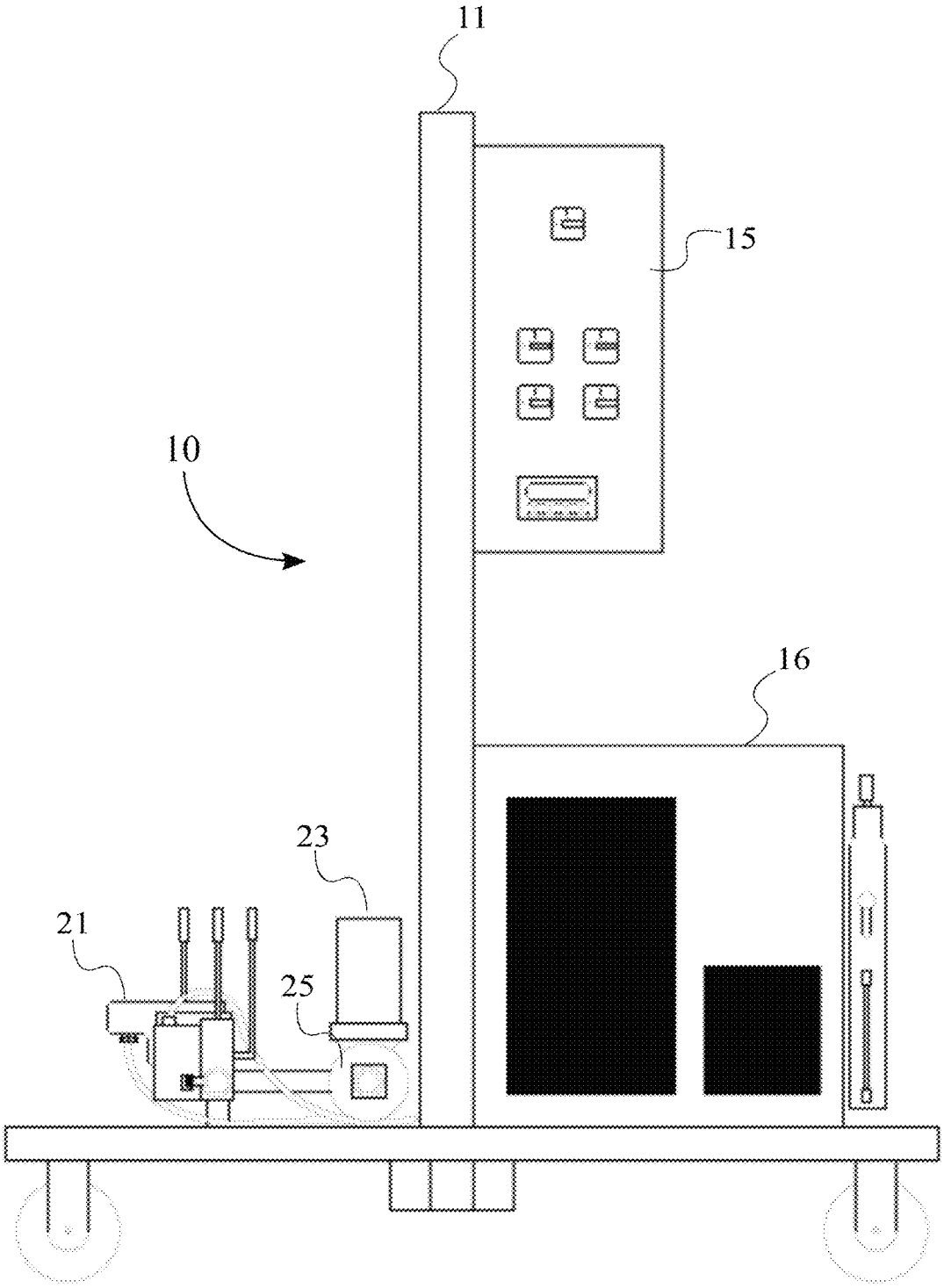
FIG. 6 is a left view of an embodiment of the hydroburner system of the present invention.
Figure 7:
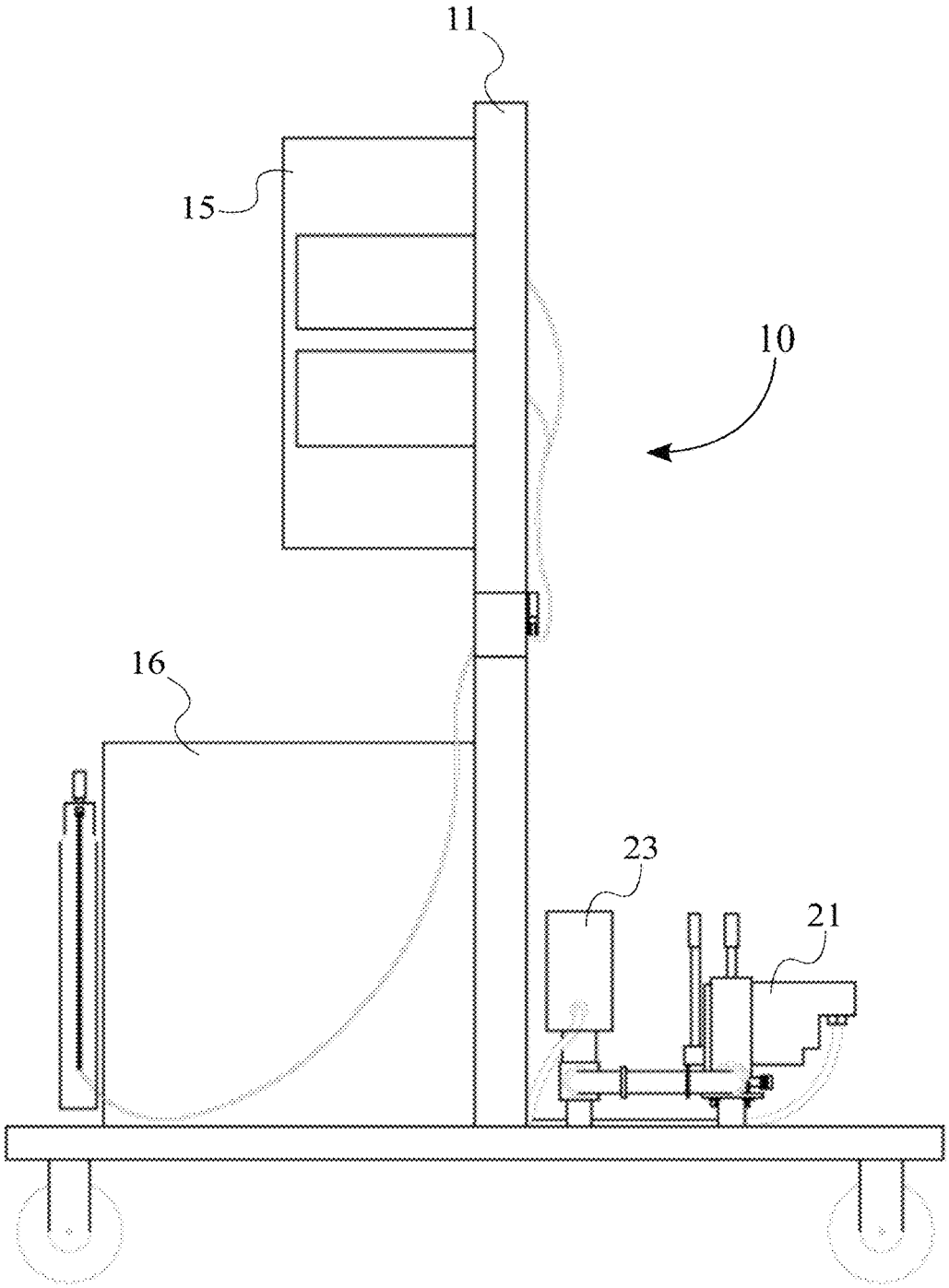
FIG. 7 is a right view of an embodiment of the hydroburner system of the present invention.
Figure 8:
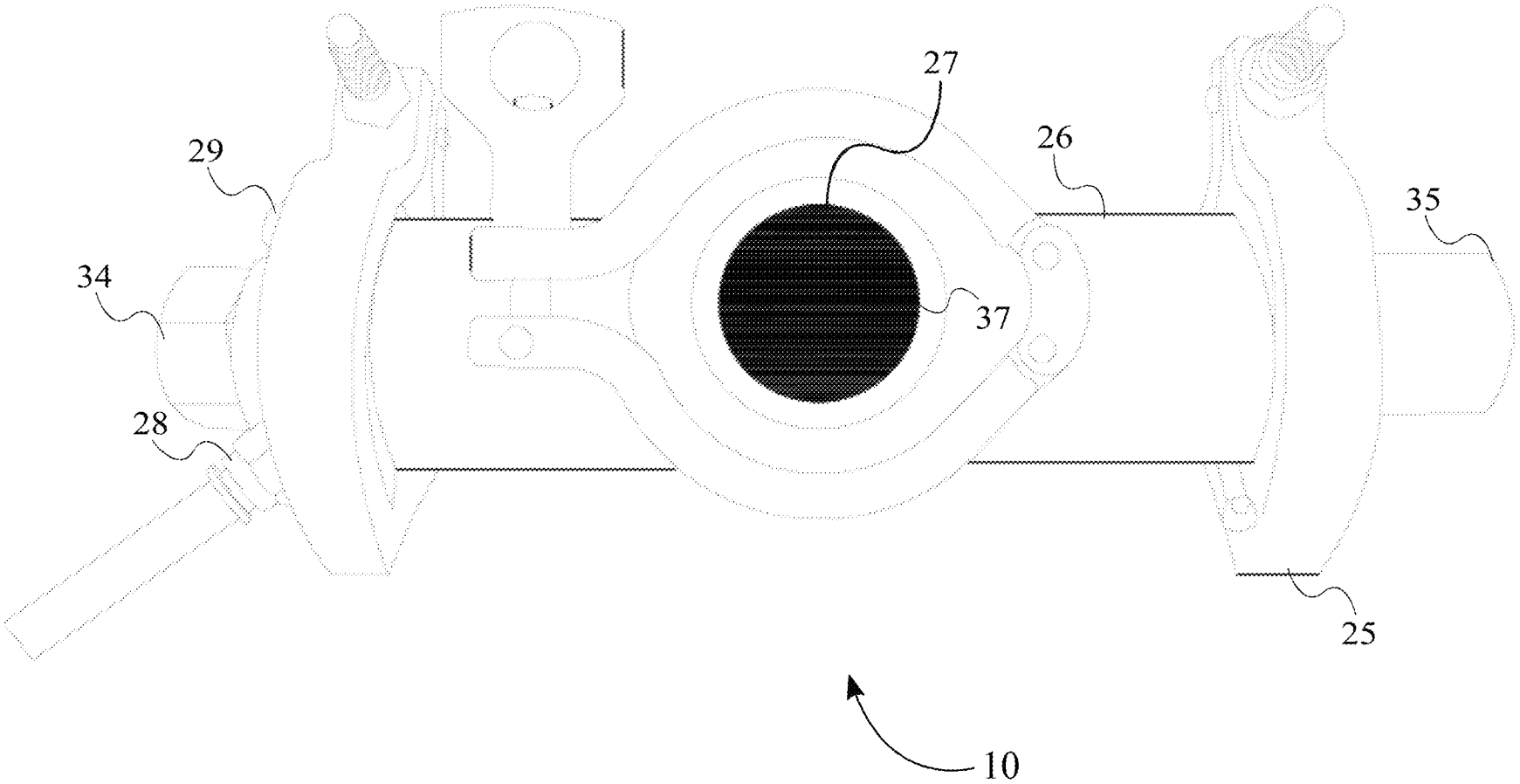
FIG. 8 is a front view of a gas mixer of the hydroburner system of the present invention.
Figure 9:
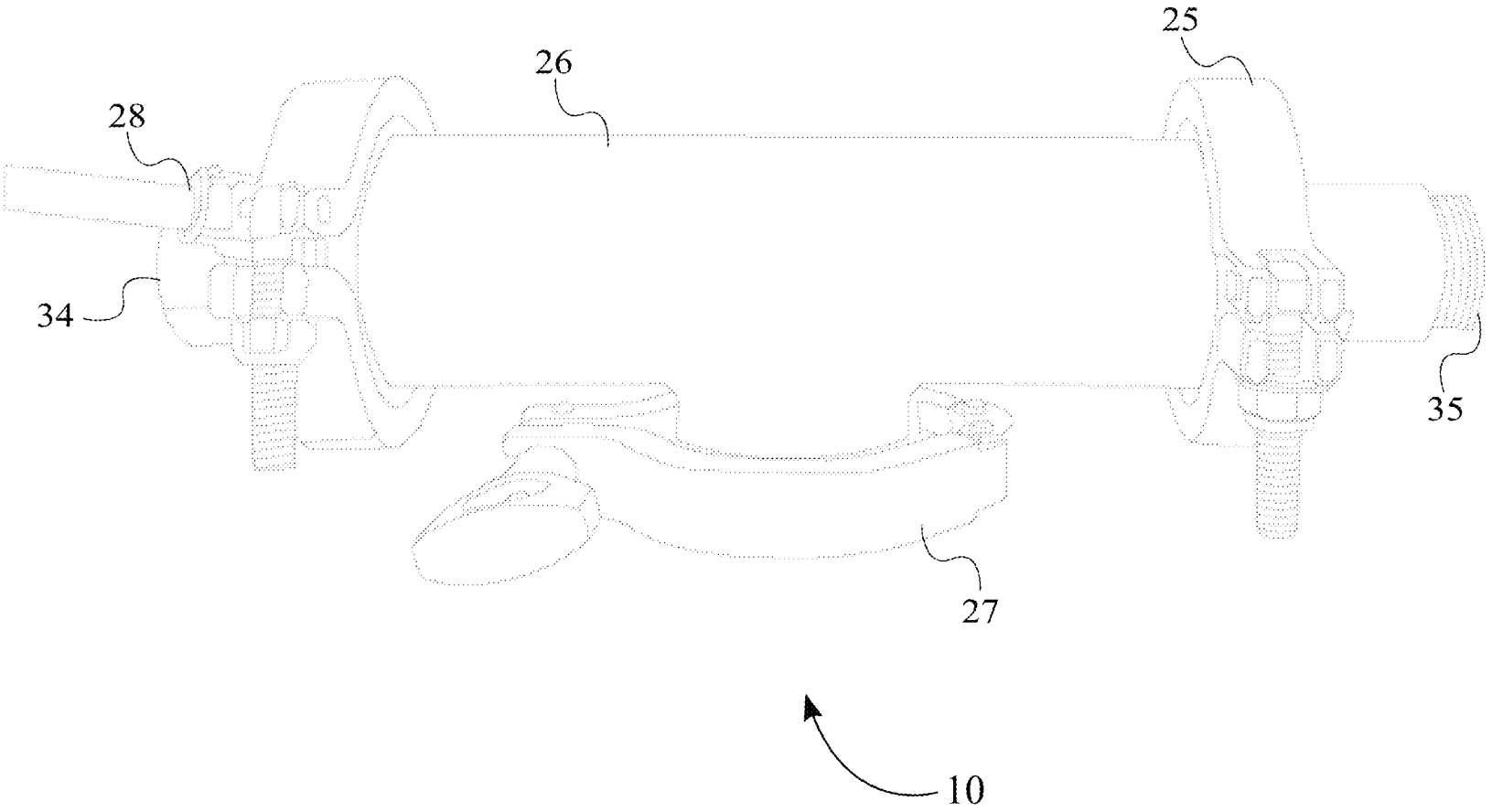
FIG. 9 is a top view of a gas mixer of the hydroburner system of the present invention.

All illustrations of the drawings are for the purpose of describing selected versions of the present invention and are not intended to limit the scope of the present invention.

As can be seen in FIG. 1 to FIG. 10, the present invention provides an oxyhydrogen (HHO) burner system to eliminate emissions through total combustion. The HHO burner system of the present invention can be added to any exhaust system and/or exhaust stack to reduce emissions by passing the exhaust and/or gases through the flames and heat created by the present invention to create a total combustion environment. The HHO burner system works by adding one or more custom-made burners, which may have a substantial cross-section, to any stack, duct, or pipe, and delivering to the burner natural gas, propane, or any other fossil fuel gas and any type of water gas, such as HHO or Brown's gas, with or without compressed air, to create a total combustion of the exhaust before being released to the open environment. Thus, by passing all exhaust or gases through the present invention, emissions can be greatly reduced or even, in many cases, eliminated, including emissions of NOx, carbon, and sulfur dioxide.

As can be seen in FIG. 1 to FIG. 10, the present invention provides an HHO burner system to reduce and/or eliminate emissions through total combustion. The HHO burner system comprises a hydroburner system 10 and an exhaust system 50. The exhaust system 50 comprises an exhaust pipe 51, an inlet 52, an outlet 53, and an exhaust stream 54. The inlet 52 and outlet 53 are terminally and distally positioned on the exhaust pipe 51, opposite each other. The exhaust pipe can be the exhaust of an emissions stack and/or vent and may include, but is not limited to, metal pipe, duct, etc. Additionally, the exhaust stream 54 enters the exhaust pipe 51 through the inlet 52 and exits at the outlet 53. The hydroburner system 10 comprises a hydroburner 11, a gas pipe 12, and a burner assembly 13. More specifically, the hydroburner 11 comprises a controller 15, at least one oxyhydrogen (HHO) supply 16, an external natural gas supply 36, and a gas mixer 25. The at least one HHO supply 16 and the external natural gas supply 36 are connected to the gas mixer 25. The controller 15 is adapted to provide a predetermined mixing ratio of the HHO gas and natural gas to the gas mixer 25 for thorough mixing. The burner assembly 13 is connected to the gas mixer 25 of the hydroburner 11 through the gas pipe 12. Additionally, the burner assembly 13 is positioned adjacent the exhaust pipe 51 of the exhaust system 50, between the inlet 52 and outlet 53. Further, the burner assembly 13 is adapted to distribute a flame onto a cross section of the interior of the exhaust pipe 51, thus providing total combustion to the exhaust stream 54 inside the exhaust pipe 51.

As can be seen in FIG. 2 to FIG. 7, and FIG. 10, the hydroburner 11 of the hydroburner system 10 comprises a check valve 22, a flow control valve 21, an isolation valve 19, and an actuator 23. More specifically, the check valve 22 is connected to the external natural gas supply 36. Both the check valve 22 and the isolation valve 19 are connected to the flow control valve 21. The isolation valve 19 provides a convenient gas shutoff to conduct any system maintenance, repair, check/inspections, etc. Both the flow control valve 21 and the actuator 23 are connected to the controller 15. Additionally, the actuator 23 is connected to the gas mixer 25. The connections in the hydroburner system 10 may include, but are not limited to, common gas pipes, tubes, joints, unions, and any other suitable piping parts. Further, the flow control valve 21 of the hydroburner 10 comprises a pressure regulator, which is connected to the controller 15 to regulate the gas pressure of the hydroburner 10 below a predetermined safe operation pressure. Thus, the flow control valve 21 is actuated by the controller 15 that monitors multiple functions, including, but not limited to, providing gas flowrate monitoring/adjustment, allowing gas to flow safely through the system, etc. Additionally, the controller 15 of the hydroburner 10 is adapted to regulate the pressure and flowrate of the incoming natural gas through the actuator 23. Further, the at least one HHO supply 16 of the hydroburner 10 is electrically connected to the controller 15. The controller 15 is adapted to regulate the pressure and flowrate of the HHO gas being delivered to the gas mixer 25.

As can be seen in FIG. 2 to FIG. 7, and FIG. 10, the at least one HHO supply 16 of the hydroburner 10 comprises a spark arrestor 17, which is electrically connected to the controller 15. The controller 15 is adapted to shut down the at least one HHO supply 16 through the spark arrestor 17 in case a flashback occurs to the at least one HHO supply 16. The spark arrestor 17 of the at least one HHO supply 16 comprises a bleeding valve 33 and a plurality of lights 16. Both the bleeding valve 33 and the plurality of lights 16 are electrically connected to the controller 15, which is adapted to relieve the pressure of the at least one HHO supply 16 through the bleeding valve in case a flashback occurs. Additionally, the controller 15 is adapted to display operating status of the at least one HHO supply 16 through the plurality of the lights 18.

As can be seen in FIG. 2 to FIG. 10, the gas mixer 25 of the hydroburner 10 comprises a mixing chamber 26, an implosion disk 27, a hole 37, a first inlet 28, a second inlet 29, a main inlet 34, and a mixed gas outlet 35. More specifically, the main inlet 34 is terminally and distally positioned on the mixing chamber 26. Both the first inlet 28 and the second inlet 29 are terminally positioned on the mixing chamber adjacent the main inlet 34. The mixed gas outlet 35 is terminally and distally positioned on the mixing chamber 26, opposite the main inlet 34. The hole 37 is laterally positioned on the mixing chamber 26, between the main inlet 34 and the mixed gas outlet 35. The implosion disk 27 is mounted within the hole 37 to rupture at a predetermined high pressure to relieve gas pressure of the mixing chamber 26. Additionally, the at least one HHO supply 16 is connected to the first inlet 28 or second inlet 29 of the gas mixer 25 through the spark arrestor 17. The actuator 23 is connected to the main inlet 35 of the gas mixer 25 so that the HHO gas from the actuator 23 is delivered to the mixing chamber 25 of the gas mixer 25 to be mixed with the natural gas. Further, the hydroburner 10 comprises a metering device 31 and a limiting valve 32. The limiting valve 32 is connected to the burner assembly 13 through the gas pipe 12 while the metering device 31 is connected to the limited valve 32. The mixed gas from the gas mixer 25 flows out of the mixed gas outlet 35 into the metering device 31. Additionally, the mixed gas subsequently flows through the limiting valve 32 before entering the burner assembly 13. Both the metering device 31 and limited valve 32 are electrically connected to the controller 15. The metering device 31 is configured to provide a gas flowrate measurement to the controller 15 to determine if the desired flowrate is achieved. The controller 15 is adapted to provide the predetermined gas flowrate through the limiting valve 32 via appropriate adjustments. Further, the present invention allows a user to manually read the gas flowrate using a suitable external instrument through the metering device 31 and make necessary adjustments to the limiting valve 32 to achieve the predetermined flowrate of the mixed gas being delivered to the burner assembly 13.

Figure 10:
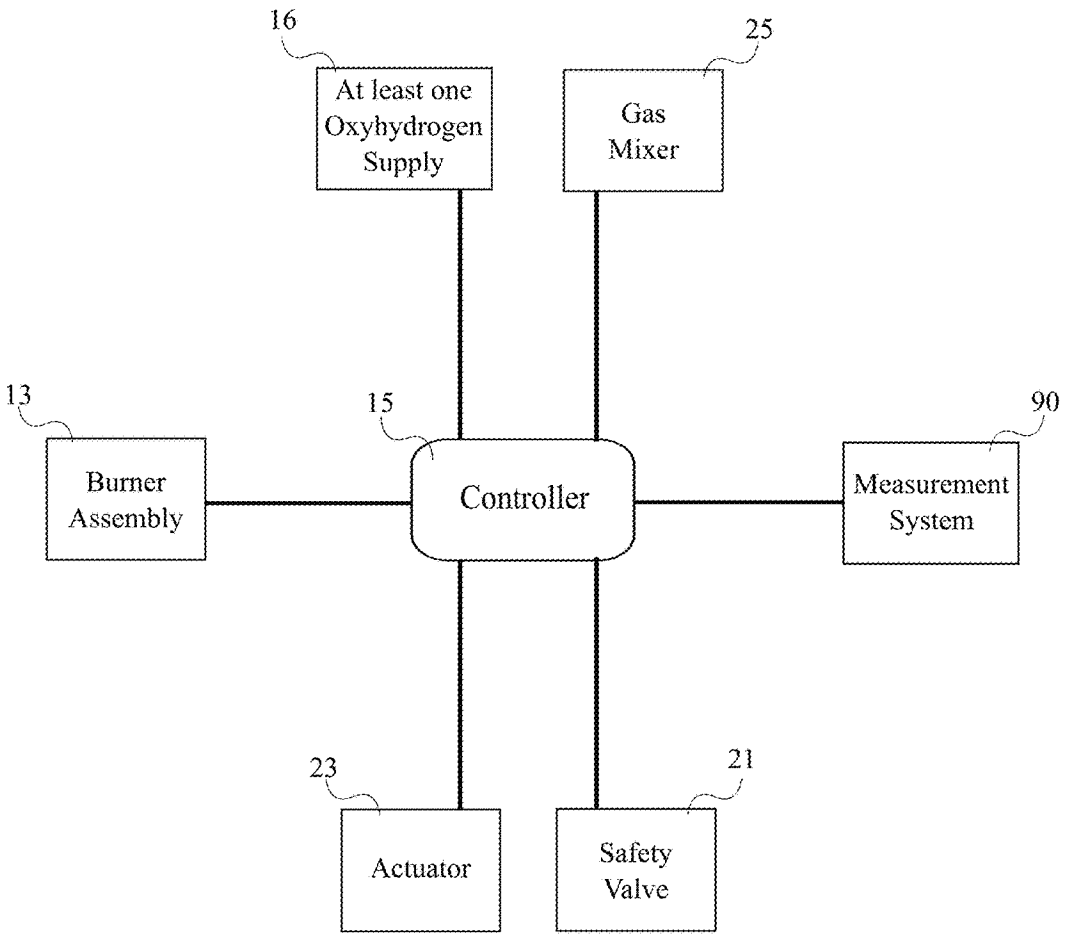
FIG. 10 is an electrical diagram of the hydroburner system of the present invention.

As can be seen in FIG. 1 and FIG. 10, the HHO burner system of the present invention comprises a measurement system 10 that provides critical emissions measurements and input feedback to the controller 15 of the hydroburner system 10 to achieve the desired reduction and/or elimination of emissions contained in the exhaust stream 54 inside the exhaust pipe 51. More specifically, the measurement system 10 comprises an analytical instrument 91 and a plurality of sensors 92. The plurality of sensors 92 is electrically connected to the analytical instrument 91. Each of the plurality of sensors 92 is mounted on interior of the exhaust pipe 51 of the exhaust system 50, adjacent the outlet 53. The plurality of sensors 92 may include, but is not limited to, an electromechanical emissions sensor, a photoionization (PID) sensor, a nondispersive infrared (NDIR) sensor, and any other suitable sensors. Further, the measurement system 90 is electrically connected to the controller 15 of the hydroburner 10 of the hydroburner system 10 and the controller 15 is adapted to adjust to hydroburner 10 using the measurement system 90 to eliminate emissions in the exhaust stream 54 exiting the outlet 53 of the exhaust pipe 51 of the exhaust system 50. In alternative embodiments of the present invention, the HHO burner system may include, but is not limited to, a plurality of hydroburner systems 10. More specifically, the burner assembly 13 of each of the plurality of hydroburner systems 10 is connected to the exhaust pipe 51 of the exhaust system 50 through the gas pipe 12. Additionally, the burner assembly 13 of each of the plurality of hydroburner systems 10 is adapted to distribute a flame onto a cross section of the interior of the exhaust pipe 51, between the inlet 52 and outlet 53. Thus, multiple burner assemblies may be installed in the HHO burner system to provide cascade configuration to provide a series of HHO/natural gas flames to achieve complete elimination of emissions in the exhaust stream 54 through total combustion.

Although the invention has been explained in relation to its preferred embodiment, it is to be understood that many other possible modifications and variations can be made without departing from the spirit and scope of the invention as hereinafter claimed.

What is claimed is:

1. An Oxyhydrogen burner system for reducing and eliminating emissions through total combustion comprising:

a hydroburner system;

an exhaust system;

the exhaust system comprising an exhaust pipe, an inlet, and an outlet;

the inlet and outlet being terminally and distally positioned on the exhaust pipe, opposite each other;

the hydroburner system comprising a hydroburner, a gas pipe, and a burner assembly;

the hydroburner comprising a controller, at least one oxyhydrogen (HHO) supply, an external natural gas supply, and a gas mixer;

the at least one HHO supply and the external natural gas supply being connected to the gas mixer;

the controller being adapted to provide a predetermined mixing ratio of the HHO gas and natural gas to the gas mixer;

the burner assembly being connected to the gas mixer of the hydroburner through the gas pipe;

the burner assembly being positioned adjacent the exhaust pipe of the exhaust system, between the inlet and outlet;

the burner assembly being adapted to distribute a flame onto a cross section of the interior of the exhaust pipe;

the at least one HHO supply of the hydroburner comprising a spark arrestor;

the spark arrestor being electrically connected to the controller; and the controller being adapted to shut down the at least one HHO supply through the spark arrestor in case a flashback occurs.

2. The HHO burner system for reducing and eliminating emissions through total combustion as claimed in claim 1 comprising:

the hydroburner of the hydroburner system comprising a check valve, a flow control valve, an isolation valve, and an actuator;

the check valve being connected to the external natural gas supply;

both the check valve and isolation valve being connected to the flow control valve;

both the flow control valve and the actuator being connected to the controller; and the actuator being connected to the gas mixer.

3. The HHO burner system for reducing and eliminating emissions through total combustion as claimed in claim 2 comprising:

the flow control valve of the hydroburner comprising a pressure regulator; and the pressure regulator being connected to the controller to regulate the gas pressure of the hydroburner below a predetermined safe operation pressure.

4. The HHO burner system for reducing and eliminating emissions through total combustion as claimed in claim 2 comprising:

the controller of the hydroburner being adapted to regulate the pressure and flowrate of the incoming natural gas through the actuator.

5. The HHO burner system for reducing and eliminating emissions through total combustion as claimed in claim 1 comprising:

the at least one HHO supply of the hydroburner being electrically connected to the controller; and the controller being adapted to regulate the pressure and flowrate of the HHO gas being delivered to the gas mixer.

6. The HHO burner system for reducing and eliminating emissions through total combustion as claimed in claim 1 comprising:

the spark arrestor of the at least one HHO supply comprising a bleeding valve and a plurality of lights;

both the bleeding valve and the plurality of lights being electrically connected to the controller;

the controller being adapted to relieve the pressure of the at least one HHO supply through the bleeding valve in case a flashback occurs; and the controller being adapted to display operating status of the at least one HHO supply through the plurality of the lights.

7. The HHO burner system for reducing and eliminating emissions through total combustion as claimed in claim 1 comprising:

the gas mixer of the hydroburner comprising a mixing chamber, a first inlet, a second inlet, a main inlet, and a mixed gas outlet;

the main inlet being terminally and distally positioned on the mixing chamber;

both the first inlet and the second inlet being terminally positioned on the mixing chamber adjacent the main inlet; and the mixed gas outlet being terminally and distally positioned on the mixing chamber, opposite the main inlet.

8. The HHO burner system for reducing and eliminating emissions through total combustion as claimed in claim 7 comprising:

the gas mixer of the hydroburner comprising a hole and an implosion disk;

the hole being laterally positioned on the mixing chamber, between the main inlet and the mixed gas outlet; and the implosion disk being mounted within the hole to rupture at a predetermined high pressure to relieve gas pressure of the mixing chamber.

9. The HHO burner system for reducing and eliminating emissions through total combustion as claimed in claim 7 comprising:

the at least one HHO supply being connected to the first inlet or second inlet of the gas mixer through the spark arrestor; and the actuator being connected to the main inlet of the gas mixer.

10. The HHO burner system for reducing and eliminating emissions through total combustion as claimed in claim 1 comprising:

the hydroburner of the hydroburner system comprising a metering device and a limiting valve;

the limiting valve being connected to the burner assembly through the gas pipe;

the metering device being connected to the limited valve;

the metering device being connected to the gas mixer;

both the metering device and limiting valve being electrically connected to the controller;

the metering device being configured to provide gas flowrate to the controller; and the controller being adapted to provide a predetermined gas flowrate to the burner assembly through the limiting valve.

11. The HHO burner system for reducing and eliminating emissions through total combustion as claimed in claim 1 comprising:

a plurality of hydroburner systems;

the burner assembly of each of the plurality of hydroburner systems being connected to the exhaust pipe of the exhaust system; and the burner assembly of each of the plurality of hydroburner systems being adapted to distribute a flame onto a cross section of the interior of the exhaust pipe, between the inlet and outlet.

12. The HHO burner system for reducing and eliminating emissions through total combustion as claimed in claim 1 comprising:

a measurement system;

the measurement system comprising an analytical instrument and a plurality of sensors;

the plurality of sensors being electrically connected to the analytical instrument; and each of the plurality of sensors being mounted on interior of the exhaust pipe of the exhaust system, adjacent the outlet.

13. The HHO burner system for reducing and eliminating emissions through total combustion as claimed in claim 12 comprising:

the measurement system being electrically connected to the controller of the hydroburner of the hydroburner system; and the controller of the hydroburner being adapted to adjust to hydroburner using the measurement system to eliminate emissions exiting the outlet of the exhaust pipe of the exhaust system.

14. The HHO burner system for reducing and eliminating emissions through total combustion as claimed in claim 12 comprising:

the plurality of sensors comprising an electromechanical emissions sensor.

15. The HHO burner system for reducing and eliminating emissions through total combustion as claimed in claim 12 comprising:

the plurality of sensors comprising a photoionization (PID) sensor.

16. The HHO burner system for reducing and eliminating emissions through total combustion as claimed in claim 12 comprising:

the plurality of sensors comprising a nondispersive infrared (NDIR) sensor.

17. An Oxyhydrogen burner system for reducing and eliminating emissions through total combustion comprising:

a plurality of hydroburner systems;

an exhaust system;

the exhaust system comprising an exhaust pipe, an inlet, and an outlet;

the inlet and outlet being terminally and distally positioned on the exhaust pipe, opposite each other;

each of plurality of hydroburner systems comprising a hydroburner, a gas pipe, and a burner assembly;

the hydroburner comprising a controller, at least one oxyhydrogen (HHO) supply, an external natural gas supply, and a gas mixer;

the at least one HHO supply and the external natural gas supply being connected to the gas mixer;

the controller being adapted to provide a predetermined mixing ratio of the HHO gas and natural gas to the gas mixer;

the burner assembly being connected to the gas mixer of the hydroburner through the gas pipe;

the burner assembly being positioned adjacent the exhaust pipe of the exhaust system, between the inlet and outlet; and the burner assembly being adapted to distribute a flame onto a cross section of the interior of the exhaust pipe.

* * * * *